United States Patent [19]

Igarashi et al.

[11] Patent Number: 4,586,351

[45] Date of Patent: May 6, 1986

[54] HEAT PUMP WITH MULTIPLE COMPRESSORS

[75] Inventors: Yoshinobu Igarashi; Takashi Nakamura, both of Wakayama, Japan

[73] Assignee: Mitsubishi Denki Kabushiki Kaisha, Tokyo, Japan

[21] Appl. No.: 735,214

[22] Filed: May 17, 1985

[30] Foreign Application Priority Data

May 18, 1984 [JP] Japan ..... 59-101264

[51] Int. Cl.[4] ..... F25B 43/02

[52] U.S. Cl. ..... 62/468; 62/510

[58] Field of Search ..... 62/84, 468, 510

[56] References Cited

U.S. PATENT DOCUMENTS

| | | | |
|---|---|---|---|
| 3,633,377 | 1/1972 | Quick | 62/468 |
| 3,873,289 | 3/1975 | White | 62/468 |
| 4,213,307 | 7/1980 | Watson | 62/468 |
| 4,383,802 | 5/1983 | Gianni et al. | 62/510 |
| 4,435,962 | 3/1984 | Mochizuki et al. | 62/510 |
| 4,530,215 | 7/1985 | Kramer | 62/468 |

FOREIGN PATENT DOCUMENTS

| | | |
|---|---|---|
| 55-45810 | 11/1980 | Japan . |
| 55-48230 | 12/1980 | Japan . |

*Primary Examiner*—Ronald C. Capossela

*Attorney, Agent, or Firm*—Leydig, Voit, & Mayer, Ltd.

[57] ABSTRACT

A heat pump having a plurality of compressors disposed in parallel is disclosed. An oil separator is disposed on the discharge sides of the compressors so as to separate any lubricating oil entrained in the refrigerant discharged from the compressors. The lubricating oil is accumulated in the oil separator and is then passed to an accumulator, from where it is returned to the compressors with returning refrigerant. Control means are provided for controlling the flow of oil from the oil separator into the accumulator. Rather than passing through the heat exchangers of the apparatus, the lubricating oil is quickly returned to the compressors from which it is discharged, thereby preventing oil shortages from developing in the compressors. Check valves are provided on the intake and discharge sides of the compressors to prevent liquids remaining in the piping of the apparatus from accumulating in the intake and discharge openings of a stopped compressor, thereby preventing damage to the valves of the compressors at start-up.

8 Claims, 3 Drawing Figures

HEAT PUMP WITH MULTIPLE COMPRESSORS

BACKGROUND OF THE INVENTION

The present invention relates to a heat pump having a plurality of compressors operated in parallel. More particularly, it relates to a heat pump in which the supply of oil to the compressors is improved.

A conventional heat pump of the type having a plurality of compressors connected in parallel is illustrated in FIG. 1. The illustrated apparatus is used as a heat pump for heating or cooling a building. A pair of compressors 1 and 2 are connected in parallel between a first heat exchanger 3, which in this case is an indoor heat exchanger, and a second heat exchanger 4, which in this case is an outdoor heat exchanger, via a 4-way valve 7 and piping 20. The two heat exchangers 3 and 4 are connected with one another via an expansion valve 5. An accumulator 6 is connected between the 4-way valve 7 and the intake side of one of the compressors so that all refrigerant returning to the compressors passes through the accumulator 6. In this manner, a closed loop is formed along which refrigerant can flow from the compressors 1 and 2 to the outdoor heat exchanger 4, through the expansion valve 5, to the indoor heat exchanger 3, through the accumulator 6, and back to the compressors 1 and 2 or in the reverse direction. The 4-way valve 7 enables either of the heat exchangers to be connected to the discharge side of the compressors while the other heat exchanger is connected to the intake side of the compressors via the accumulator 6 so that the apparatus can be operated in either a heating or cooling mode.

The bottom portions of both compressor are connected with one another by an oil equalizing pipe 15 through which oil can flow between the compressors when there is an imbalance in the amount of oil in the compressors. It also serves to prevent refrigerant from accumulating inside a stopped compressor, as well as to maintain the temperature of a stopped compressor at about the same level as a compressor which is running by passing a portion of high-temperature refrigerant from the compressor which is operating to the compressor which is stopped.

In such an apparatus, the compressors may be operated both at the same time or only one at a time, depending on the heating or cooling load.

During operation, lubricating oil for the compressors is continuously discharged from the compressors due to entrainment in the refrigerant, and the oil circulates through the heat exchangers and piping together with the refrigerant. When the piping connecting the compressors with the heat exchangers is extremely long, it takes a long time for the oil to circulate through the piping and return to the compressors. This can result in a shortage of lubricating oil developing in one or both of the compressors, producing jamming and damage to the compressors. This is particularly the case at start-up of the compressors, when foaming produces differences between the compressors in the amount of discharged oil and in the amount of returning oil.

Another problem with this conventional apparatus occurs when the compressors are stopped. Refrigerant and oil which remains in the piping at the time of stopping the compressors is free to return to the intake and discharge sides of the compressors due to gravity. The intake and discharge opening of the compressors can become filled with condensed refrigerant and lubricating oil, which can cause damage to the valves of the compressors when the apparatus is restarted.

SUMMARY OF THE INVENTION

It is the object of the present invention to overcome the above-described drawbacks of conventional apparatuses of this type and provide a heat pump in which the supply of lubricating oil to the compressors is reliable and no oil shortages can develop in the compressors even when the piping of the apparatus is extremely long.

It is another object of the present invention to provide a heat pump in which refrigerant and lubricating oil are prevented from accumulating at the intake and discharge openings of a stopped compressor.

In a heat pump according to the present inventions, an oil separator is provided between the discharge sides of a plurality of compressors connected in parallel and the heat exchangers of the apparatus. Refrigerant discharged from the compressors passes through the oil separator, and oil entrained in the refrigerant is separated therefrom and accumulated in the oil separator so that the refrigerant which passes through the heat exchangers is free of oil. The bottom of the oil separator is connected to an accumulator, and oil accumulated in the oil separator is passed to the accumulator by suitable control means, and from the accumulator it is returned to the compressors. As oil entrained in the refrigerant does not pass through the heat exchangers, it can be quickly returned to the compressors, preventing shortages of oil from developing in the compressors.

Furthermore, check valves are provided on the intake and discharge sides of the compressors so as to prevent liquid remaining in the piping of the apparatus from flowing into the intake and discharge openings of the compressors when they are not operating. Damage to the valves of the compressors at start-up can thereby be prevented.

BRIEF DESCRIPTION OF THE DRAWINGS

In the drawings, the same reference numerals indicate the same or corresponding parts.

DESCRIPTION OF THE PREFERRED EMBODIMENTS

One embodiment of a heat pump according to the present invention will now be described while referring to FIG. 2, which is a schematic diagram of this embodiment.

Figure 1:
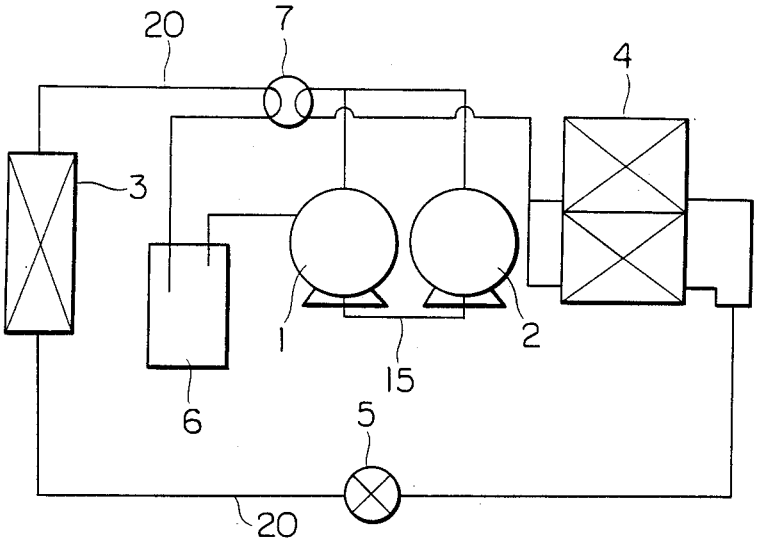
FIG. 1 PRIOR ART
FIG. 1 is a schematic view of a conventional heat pump having a plurality of compressors connected in parallel.

Like the apparatus of FIG. 1, the illustrated embodiment is a heat pump comprising a first compressor 1 and a second compressor 2 connected in parallel between a first heat exchanger 3 and a second heat exchanger 4 via a 4-way valve 7, and the first heat exchanger and the second heat exchanger 4 are connected with one another via an expansion valve 5. Between the 4-way valve 7 and the intake sides of the compressors, an accumulator 6 is provided through which all returning refrigerant passes before returning to the compressors.

The accumulator 6 has a refrigerant inlet connected to the 4-way valve 7, an outlet connected to the intake sides of the compressors, and an oil inlet.

Whereas in the apparatus of FIG. 1, refrigerant and lubricating oil passed directly from the discharge sides of the compressors to either of the heat exchangers, in the present embodiment, an oil separator 8 is connected between the discharge sides of both compressors and the 4-way valve 7. The oil separator 8 has two inlets which are connected to the discharges sides of the compressors, a refrigerant outlet in its top portion which is connected to the 4-way valve 7, and an oil outlet in its bottom portion which is connected to the oil inlet of the accumulator 6. All refrigerant discharged from the compressors passes through the oil separator 8 in which any entrained lubricating oil is separated from the refrigerant. The refrigerant then passes out of the refrigerant outlet in the top of the oil separator 8 and flows to one of the heat exchangers via the 4-way valve 7 which is connected to the refrigerant outlet of the oil separator 8. Oil which is separated from the refrigerant in the oil separator 8 accumulates in the bottom thereof.

The oil outlet formed in the bottom portion of the oil separator 8 is connected with the oil inlet of the accumulator 6 via a solenoid valve 9 which controls the flow of oil from the oil separator 8 to the accumulator 6. When the valve 9 is opened, oil flows into the oil inlet of the accumulator 6 from the oil separator 8 and is then returned to the intake sides of the compressors 1 and 2 by entrainment in refrigerant returning to the compressors. The opening of the solenoid valve 9 is controlled by suitable control means so as to open at regular intervals, so as to open for a certain length of time when the amount of oil accumulated in the bottom of the oil separator 8 has reached a certain level, or according to some other suitable criterion.

In addition to the above, a number of check valves are provided to prevent the flow of liquid into the intake and discharge openings of the compressors when they are stopped. A first check valve 10 and a second check valve 11 are provided between the inlets of the oil separator 8 and the discharge side of the first compressor 1 and the discharge side of the second compressor 2, respectively. These check valves 10 and 11 close whenever the corresponding compressor is stopped. In this manner, when either of the compressors is stopped, the corresponding check valve will prevent liquid remaining in the piping from accumulating in the discharge opening of the compressor.

Furthermore, for the same purpose, a third check valve 12 and a fourth check valve 13 are provided along the piping connecting the outlet of the accumulator 6 with the intake side of the first compressor 1 and the intake side of the second compressor 2, respectively. These check valves 12 and 13 open only when the corresponding compressor is operating, so that when either of the compressors is stopped, the corresponding check valve will close and prevent liquid remaining in the piping from accumulating in the intake opening of the compressor.

Figure 2:
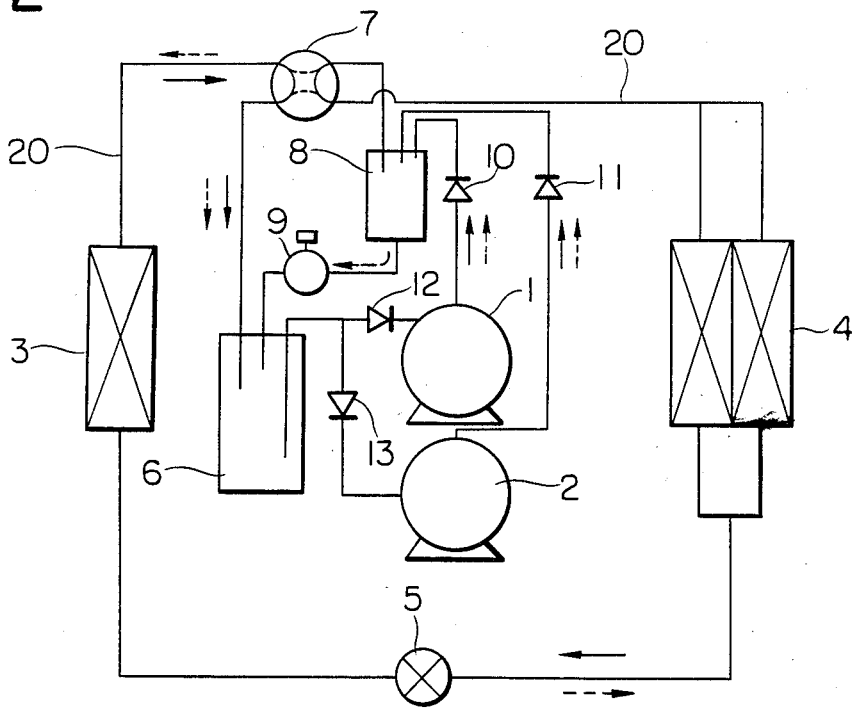
FIG. 2 is a schematic view of an embodiment of a heat pump according to the present invention.

The operation of the embodiment illustrated in FIG. 2 is as follows. During cooling operation, high temperature, high pressure refrigerant (indicated by the solid arrows) and lubricating oil (indicated by the dashed arrows) are discharged from the compressors 1 and 2 and enter the inlets in the top portion of the oil separator 8 via the check valves 10 and 11. The lubricating oil is separated from the refrigerant in the oil separator 8 and accumulates in the bottom thereof, while the refrigerant exits from the refrigerant outlet in the top of the oil separator 8 and enters the outdoor heat exchanger 4 via the 4-way valve 7. The refrigerant then flows through the expansion valve 5 into the indoor heat exchanger 3. From the indoor heat exchanger 3, it enters the accumulator 6 via the 4-way valve 7. From the accumulator 6, it returns to the compressors via the check valves 12 and 13.

Lubricating oil accumulated in the oil separator 8 flows into the accumulator 6 when the solenoid valve 9 is opened. In the accumulator 6, it is entrained in the returning refrigerant and returns to the compressors together with the refrigerant.

During heating operation, the refrigerant flows from the compressors through the oil separator 8 in the same manner as during heating, but by adjustment of the 4-way valve 7 it is caused to flow counterclockwise around the loop from the indoor heat exchanger 3 to the outdoor heat exchanger 4, as indicated by the dotted arrow. From the outdoor heat exchanger 4, the refrigerant enters the accumulator 6 via the 4-way valve 7 and is returned to the compressors 1 and 2 via the check valves 12 and 13.

As during cooling, oil separated from the refrigerant in the oil separator 8 flows into the accumulator 6 when the valve 9 is opened and is returned to the compressors by entrainment in the returning refrigerant.

It can be seen that because of the provision of the oil separator 8 between the compressors and the heat exchangers, the path along which the lubricating oil travels is greatly shortened. The return of oil to the compressors is much faster, and shortages of oil in the compressors can be thereby prevented.

Should an imbalance of oil develop between the compressors, the compressor having an excess of oil will naturally discharge a larger amount of oil than the compressor with a shortage of oil, thereby helping to resolve the imbalance. In the present invention, as the discharged oil can be quickly returned to the compressors via the oil separator, this self-adjustment mechanism possessed by the compressors can function effectively.

Furthermore, the provision of the check valves 10 through 13 on the intake and discharge sides of the compressors 1 and 2 prevents damage to the valves of the compressors due to the accumulation of liquid when either of the compressors is stopped.

Figure 3:
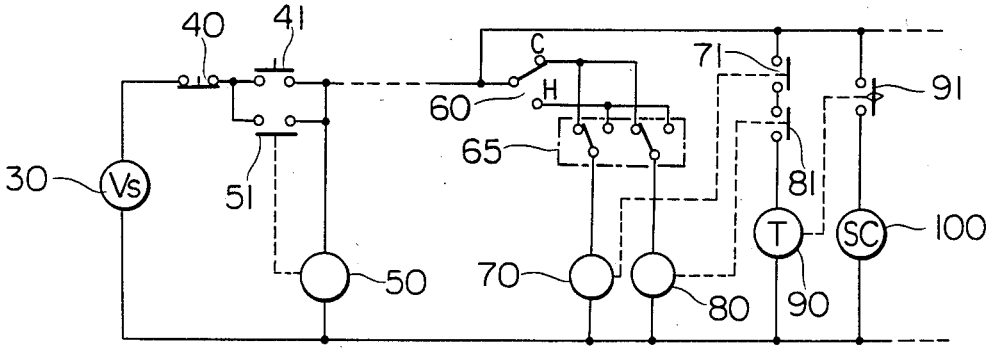
FIG. 3 is a schematic view of a control circuit for controlling the flow of oil from the oil separator to the accumulator of the apparatus of FIG. 2.

FIG. 3 illustrates one example of a control means for controlling the flow of lubricating oil from the oil separator 8 to the accumulator 6 of the embodiment of FIG. 2. In this control means, a power supply 30 is connected in series with a stop switch 40 and a start switch 41. The stop switch 40 is a push button switch which is normally closed, and the start switch 41 is a normally open push button switch. A self-maintaining relay 50 is connected across the power supply 30 via the start switch 41. The contact 51 of the relay 50 is connected across the start switch 41. The contact 51 closes when the relay 50 is energized and stays closed, energizing the relay 50, until the stop switch 40 is pushed.

A select switch 60 connected in series with the start switch 41 has two settings, C and H, corresponding to cooling and heating operation. By switching between the two positions, the apparatus can be changed from heating to cooling operation. Each of the two terminals C and H of the selector switch 60 is connected to two of the 4 input terminals of a thermostat 65. The thermostat 65 has two output terminals which are connected in series with a first compressor contactor 70 for the first compressor 1 and a second compressor contactor 80 for the second compressor 2. A contact 71 of the first compressor contactor 70, a contact 81 of the second compressor contactor 80, and a timer 90 are connected in series across the power supply 30 via the start and stop switches. Furthermore, in parallel with the contacts 71 and 81 and the timer 90, the contact 91 of the timer 90 is connected in series with the solenoid coil 100 of the solenoid valve 9 of FIG. 2. The contact 71 and 81 are open except when the respective contactors 70 and 80 are energized, and the contact 91 of the timer 90 is open except when caused to close by the timer 90, which when energized opens and closes the contact 91 at regular intervals.

The operation of this control means is as follows. When the start switch 41 is momentarily closed, the relay 50 is energized and the contact 51 of the relay 50 closes, keeping the relay 50 energized after the switch 41 is released. With the thermostat 65 set in the manner shown in the drawing, both of the contactors 70 and 80 will be energized by current from the power supply 30, and thus both of the compressors 1 and 2 will be operated. As the contactors are energized, both of the contacts 71 and 81 will close, causing the timer 90 to be energized by the power supply 30. At periodic intervals, the timer 90 causes the contact 91 to close, energizing the solenoid coil 100, which operates the solenoid valve 9 of FIG. 2 so as to open it. After a predetermined length of time, the timer 90 turns off, the contact 91 opens, the solenoid coil 100 is de-energized, and the solenoid valve 9 is closed. Thus, when both of the compressors 1 and 2 are operating at the same time, the valve 9 is periodically opened and closed to permit oil accumulated in the oil separator 8 to flow into the accumulator 6 and from there into the compressors 1 and 2.

When only a single compressor is operating at a time, it is generally not necessary to supply oil to the compressor via the oil separator 8, and accordingly the control means of FIG. 3 is designed such that when only one of the compressors is operating at a time, the timer 90 will not be energized, and the valve 9 will be closed at all times. However, by connecting the two contacts 71 and 81 in parallel with one another rather than in series, the control means can be altered so that the timer 90 is operated when either one or both of the compressors 1 and 2 is operating.

In the illustrated control means, the operation of the solenoid coil 100 is controlled by a timer 90 so that the valve 9 opens at regular intervals regardless of the amount of oil in the oil separator 8. Alternatively, the solenoid coil 100 can be controlled by a sensing device which senses the amount of oil accumulated in the oil separator 8 and energizes the solenoid coil 100 when the amount of oil reaches a certain level so as to open for a certain length of time or until the oil level reaches some desired level.

Furthermore, it is possible to use such an oil sensing device in conjunction with the timer 90 by connecting the two in parallel with one another in the circuit of FIG. 3. If this done, the opening of the solenoid valve 9 can be controlled by the oil sensing device when the oil level in the oil separator 8 exceeds a certain level, and by the timer 90 when the oil level is below this level.

The present invention was described with respect to a heat pump having an indoor and outdoor heat exchanger. However, the present invention is not so limited and can be employed as a heat pump for other uses.

Furthermore, although explanation was made with respect to an embodiment having only 2 compressors, the effects of the present invention can be achieved with an apparatus having 3 or more compressors connected in parallel.

What is claimed is:

1. A heat pump comprising:

two or more compressors connected in parallel;

a pair of heat exchangers;

an expansion valve connected between said heat exchangers;

an accumulator having a refrigerant inlet, an oil inlet, and an outlet, said outlet being connected to the intake sides of said compressors;

an oil separator having an inlet, a refrigerant outlet, and an oil outlet with said inlet being connected to the discharge sides of said compressors and said oil outlet being connected to the oil inlet of said accumulator; and check valves connected between the intake sides of said compressors and the outlet of said accumulator and between the discharge sides of said compressors and the inlet of said oil separator, wherein one of said heat exchangers is connected to the intake side of said compressors via said accumulator and the other of said heat exchangers is connected to the discharge side of said compressors via said oil separator.

2. A heat and cooling apparatus as claimed in claim 1, further comprising a 4-way valve connected to the gas inlet of said accumulator, the refrigerant outlet of said oil separator, and both of said heat exchangers such that either one of said heat exchangers can be connected to the discharge sides of said compressors via said oil separator while the other of said heat exchangers is connected to the intake sides of said compressors via said accumulator.

3. A heat pump as claimed in claim 2, further comprising:

a valve connected between the oil outlet of said oil separator and the oil inlet of said accumulator; and means for controlling the opening and closing of said valve.

4. A heat pump as claimed in claim 3, wherein said control means comprises timing means for opening and closing said valve at regular intervals.

5. A heat pump as claimed in claim 3, wherein said control means comprises oil sensing means for sensing the amount of oil in said oil separator and opening said valve when said amount exceeds a certain level.

6. A heat pump as claimed in claim 1, further comprising:

a valve connected between the oil outlet of said oil separator and the oil inlet of said accumulator; and means for controlling the opening and closing of said valve.

7. A heat pump as claimed in claim 6, wherein said control means comprises timing means for opening and closing said valve at regular intervals.

8. A heat pump as claimed in claim 7, wherein said control means comprises oil sensing means for sensing the amount of oil in said oil separator and opening said valve when said amount exceeds a certain level.

* * * * *